United States Patent [19]

Zimmer

[11] 3,949,666

[45] Apr. 13, 1976

[54] YIELDABLE DYESTUFF APPLICATOR FOR SCREEN PRINTER

[76] Inventor: Peter Zimmer, Untere Sparchen 54, A-6330 Kufstein, Austria

[22] Filed: Dec. 20, 1973

[21] Appl. No.: 426,909

[30] Foreign Application Priority Data

Dec. 21, 1972 Austria ..... 10941/72

[52] U.S. Cl. ..... 101/119; 101/120; 101/123; 101/124; 118/213; 118/406

[51] Int. Cl.[2] ..... B41F 15/42; B41F 15/46

[58] Field of Search ..... 101/114, 116, 119, 120, 101/123, 124; 401/197; 118/406, 213

[56] References Cited

UNITED STATES PATENTS

| | | | |
|---|---|---|---|
| 2,203,910 | 6/1940 | Issartel et al. | 101/114 X |
| 2,928,340 | 3/1960 | Stein et al. | 101/120 |
| 3,224,031 | 12/1965 | Leland | 401/197 |
| 3,804,011 | 4/1974 | Zimmer | 101/120 |

*Primary Examiner*—Edgar S. Burr
*Assistant Examiner*—R. E. Sutér
*Attorney, Agent, or Firm*—Ernest G. Montague; Karl F. Ross; Herbert Dubno

[57] ABSTRACT

A dyestuff applicator, located inside a cylindrical printing screen, comprises a horizontal ink tube which supports an axially extending ink-distributing member with freedom of relative mobility in a vertical axial plane of the tube. The distributing member, resting on the inner screen surface, forms a discharge slot communicating with the interior of the tube through a multiplicity of conduits closely spaced along the tube axis, the conduits being disconnectable from the slot with the aid of an axially slidable or rotatable shutter common to all the conduits and lodged in the distributing member. This distributing member is weighted down by the pressure of the ink in an overlying space, or by springs or fluid cushions inserted between that member and the tube.

16 Claims, 9 Drawing Figures

YIELDABLE DYESTUFF APPLICATOR FOR SCREEN PRINTER

FIELD OF THE INVENTION

My present invention relates to a dyestuff applicator for a printing machine, more particularly a screen printer in which an apertured printing screen overlies a substrate to be imprinted and is movable together with that substrate in a predetermined direction.

BACKGROUND OF THE INVENTION

In such printing machines it is known (see, for example, my copending application Ser. No. 538,560 filed 6 Jan. 1975 as a continuation of abandoned application Ser. No. 348,703 filed 6 Apr. 1973) to provide a horizontal supply tube for dyestuff to be fed to an applicator mounted on that tube within the cylindrical printing screen. Since the tube is unsupported within the screen, it may experience flexural deformation under its own weight and that of the liquid dyestuff, thereby exerting stresses upon the applicator which result in an uneven contact pressure on the inner screen surface.

OBJECT OF THE INVENTION

The object of my present invention, therefore, is to provide an improved applicator construction which prevents the transmission of such stresses from an associated supply tube.

SUMMARY OF THE INVENTION

I realize this object, in accordance with my present invention, by dividing the applicator into two parts, i.e. an elongate distributing member and guide means therefor secured to the underside of the supply tube, the distributing member being supported by the guide means with relative vertical mobility in an axial plane of the tube while resting on the screen in an area of contact between the latter and a substrate to be imprinted or otherwise treated. The treatment liquid, referred to hereinafter as ink, flows through passages in the applicator to an outlet formed in the distributing member along a narrow zone centered on the aforementioned axial plane, these passages generally lying in a multiplicity of planes transverse to the tube axis. The passages advantageously terminate within the vertically movable member in a common distributing channel paralleling the outlet which may be a slot extending axially along the bottom of that member. Between these passages and the channel I may insert a common shutter for optionally blocking or throttling the flow.

BRIEF DESCRIPTION OF THE DRAWING

The above and other features of my invention will now be described in detail with reference to the accompanying drawing in which.

SPECIFIC DESCRIPTION

Figure 1:
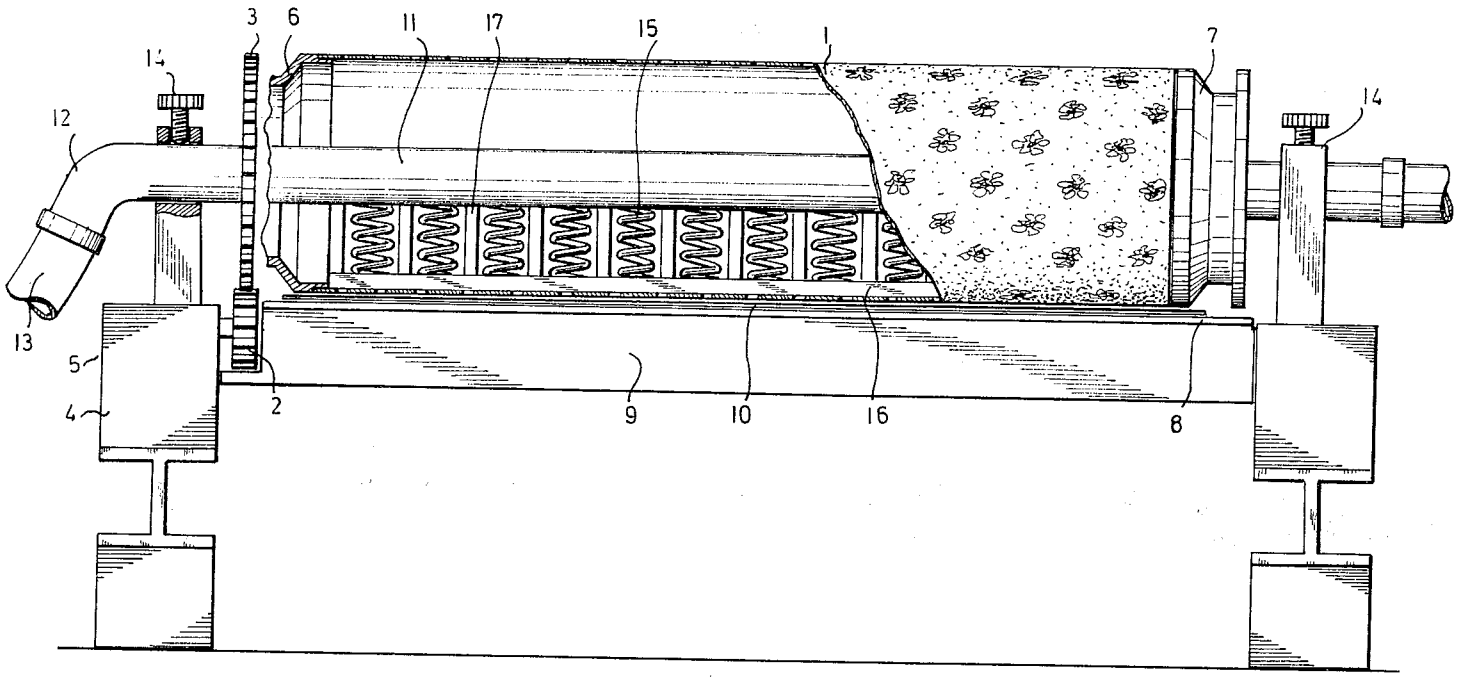
FIG. 1 is a side-elevational view (with parts broken away) of a silk screen provided with an ink applicator according to my invention, forming part of a printing machine.

In FIG. 1, a cylindrical silk screen 1 is rotatable about its axis by a gear 2 in mesh with a pinion 2 which is driven by a continuous shaft (not shown) extending longitudinally along the left side 5 of the machine through a set of gear boxes 4. The screen 1 is horizontally supported at its ends by means of heads 6 and 7 above the top 8 of a printing table 9. A web-shaped substrate 10 travels between the table top 8 and the screen 1. Within the screen there is horizontally disposed a large supply tube 11 to which ink is fed at 12 via a hose 13. Tube 11 is held down by vertically adjustable holders 14 against the force of a group of springs 15 which press an elongate distributing member 16 against the inner surface of the screen 1. Member 16 has a discharge slot from which the ink passes through the screen 1 into the web 10. The feeding of the ink from supply tube 11 into the distributor 16 is effected via vertical passages 17 which permit a change in position between the distributor and the tube.

Figure 2:
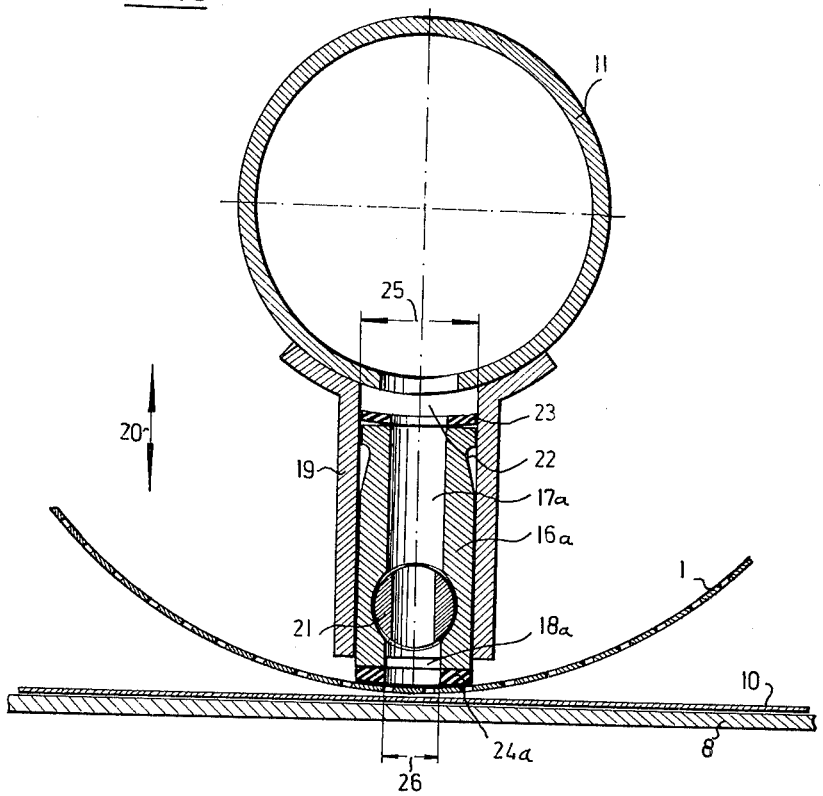
FIG. 2 is a cross-sectional view of a modified applicator according to the invention, with associated supply tube, drawn to a larger scale.
Figure 3:
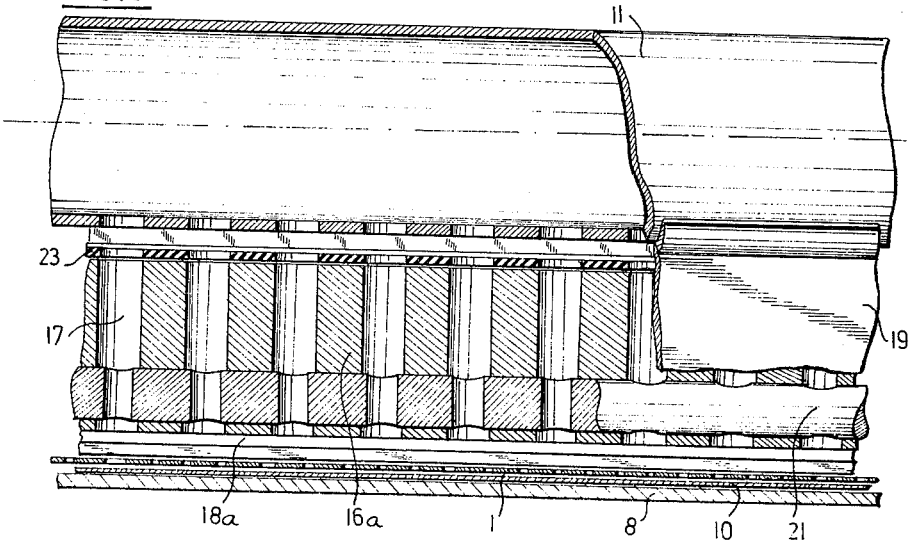
FIG. 3 is a partly sectional side view of a portion of the tube and the applicator of FIG. 2.

In FIGS. 2 and 3 I have shown a distributing member **16*a* which is vertically slidable, as indicated by an arrow 20, in a chamber 22 of an elongate guide block 19 and has a multiplicity of axially spaced passages 17*a* communicating with the interior of tube 11 and terminating at a discharge slot 18*a* which extends in the longitudinal direction of the tube. The passages 17*a*, formed as vertical bores in member 16*a*, can be throttled or blocked by a shutter 21 in the form of an apertured rod which can be rotated about its axis in the manner of a valve body and is common to all bores 17*a*. This blocking of the flow is particularly advantageous upon the stopping of the machine so that no ink can pass from the supply tube 11 through the screen 1 into the stationary web 10. It will be noted that the bores 17*a* are very closely spaced in the axial direction and that the slot 18*a* forms an ink-distributing channel whereby differences in coloring are avoided. Member 16*a* is sealed against leakage along the walls of the guide block 19 by a packing strip 23 whose edges, as shown, are bent slightly upwardly and are pressed down against the chamber walls by the ink, this ink pressure also serving to hold the member 16*a* in contact with the screen 1. The bottom of this member is formed by a sealing strip 24*a* of elastomeric material which prevents the ink from leaking tangentially between the member 16*a* and the screen 1 so that ink which leaves the slot 18*a* must enter into the web 10 wherever this is permitted in accordance with the pattern of perforations of the screen 1. The width 25 of chamber 22 must be larger than the width 26 of the slot 18*a* in order to maintain the pressure differential necessary for an effective seal between strip 24*a* and screen 1. It should be noted that the vertically movable member 16*a* is not subjected to any flexural stress but, for all practical purposes, experiences only a compressive stress from the overlying liquid. The entire flexural stress is taken up by the tube 11 which must be sufficiently strong but will still undergo some sagging; this, however, will have no effect upon the seal between the distributor 16*a* and the screen 1**.

Figure 4:
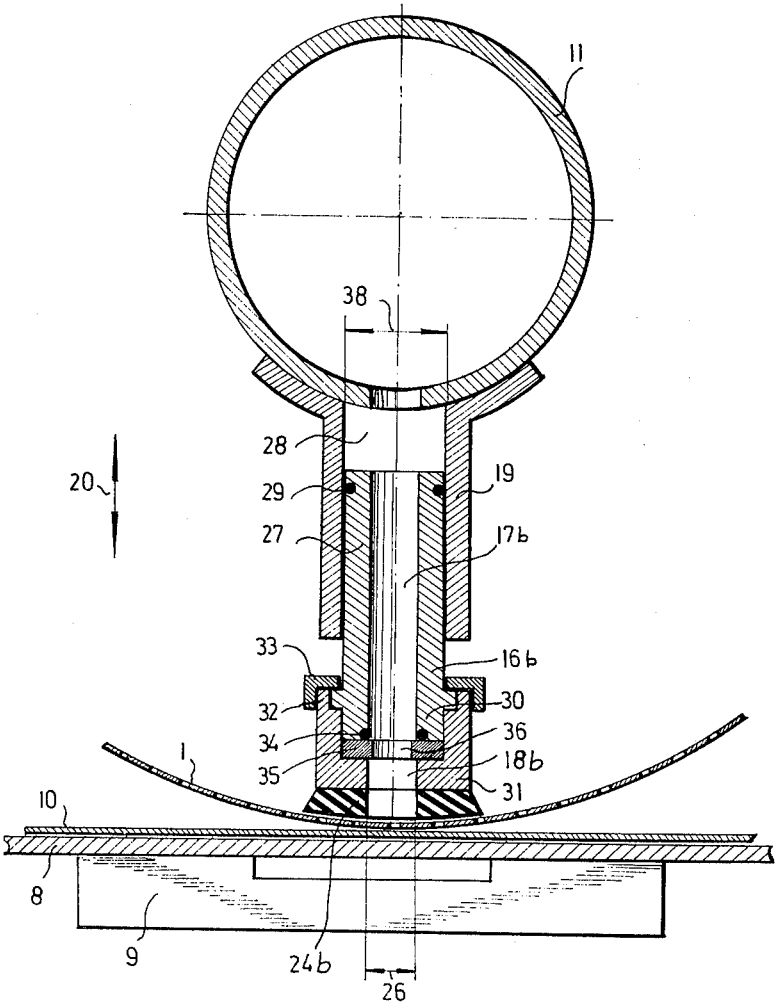
FIGS. 4 and 5 are views similar to FIGS. 2 and 3, illustrating a modification.
Figure 5:
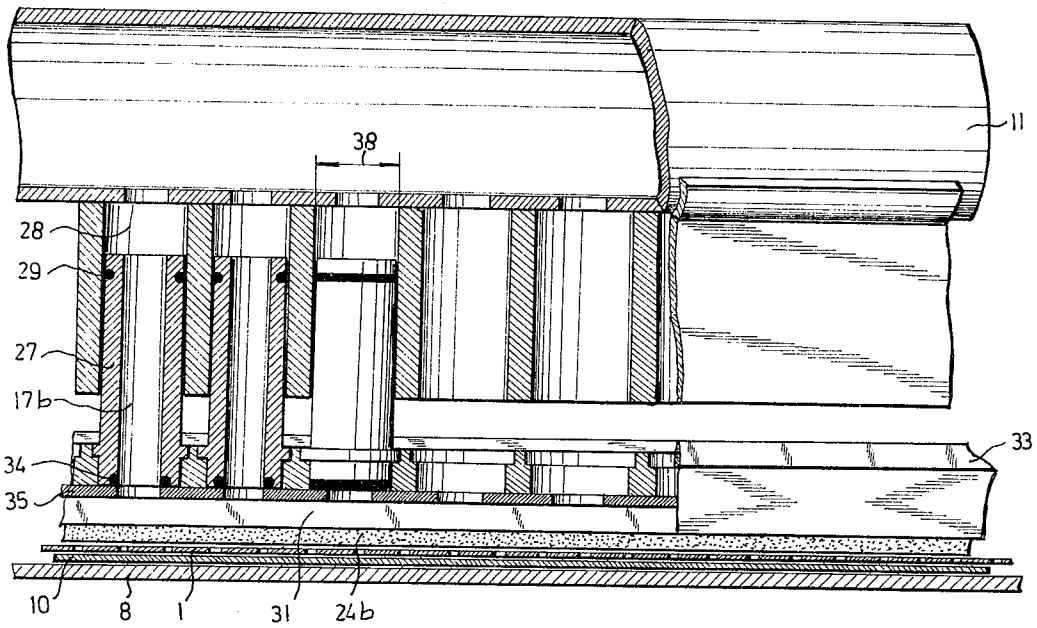

In FIGS. 4 and 5 I have shown another embodiment wherein a distributing member 16*b* comprises a plurality of pistons 27 which are arranged in a row and can slide up and down in cylinder bores 28 of the guide block 19 serving as a conduit for the dyestuff. An O-ring 29 assures sealing between the walls of bores 28 and the pistons 27. The advantage of this modification is that prevention of leakage around an elongate slider, such as the member 16*a* in FIGS. 2 and 3, is substantially more difficult — particularly at the corners thereof — than between pistons 27 and cylinder bores 28. The pistons 27 are held at their lower ends 30 in a horizontal bar 31 of rectangular cross-section formed with a discharge slot 18*b*. The pistons 27 are pressed down by angular strips 33 against seats formed by collars 32 and are sealed with respect to a shutter slide 35 by further O-rings 34. The slide 35 comprises a piece of strip iron which has holes 36 aligned with center bores 17*b* of pistons 27 whereby the outflow of dyestuff from these bores can be blocked by a horizontal displacement of the slide. Leakage between the distributing member 16*b* and the screen 1 is again prevented by an elastomeric seal 24*b* which advantageously consists of a low-friction plastic such as polytetrafluorethylene (Teflon). In this case also the sum of the piston areas 38 must be larger than the effective outlet area represented by the cross-section 26 of the slot 18*b*.

Figure 6:
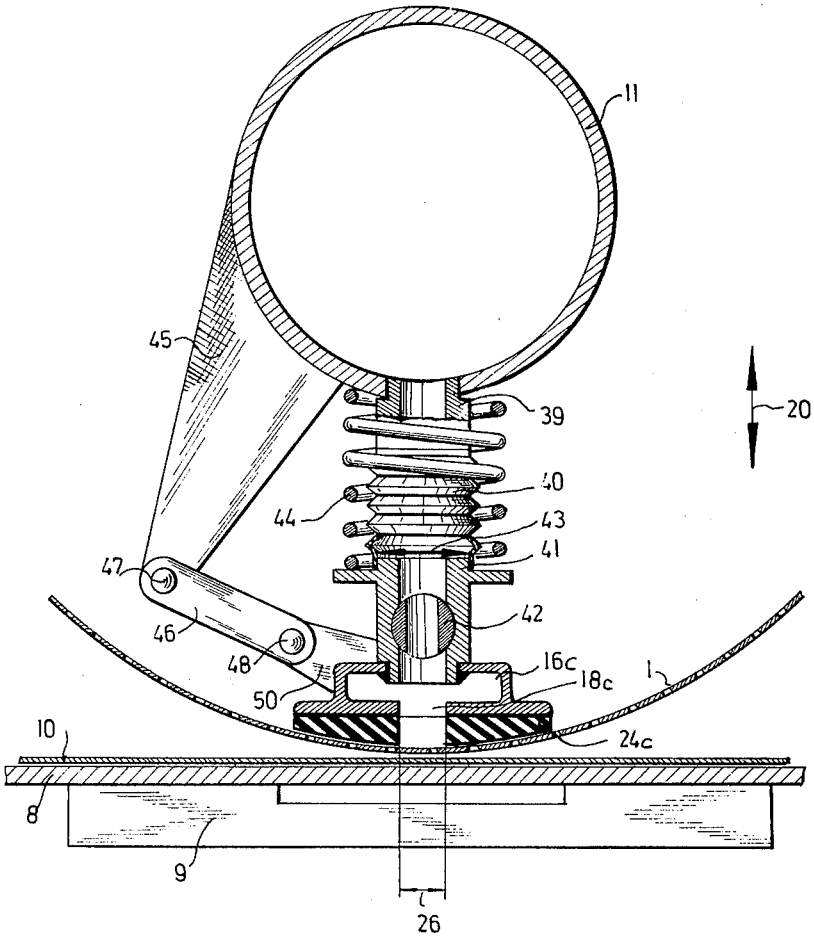
FIGS. 6 and 7 are further views similar to FIGS. 2 and 3, showing a further embodiment.
Figure 7:
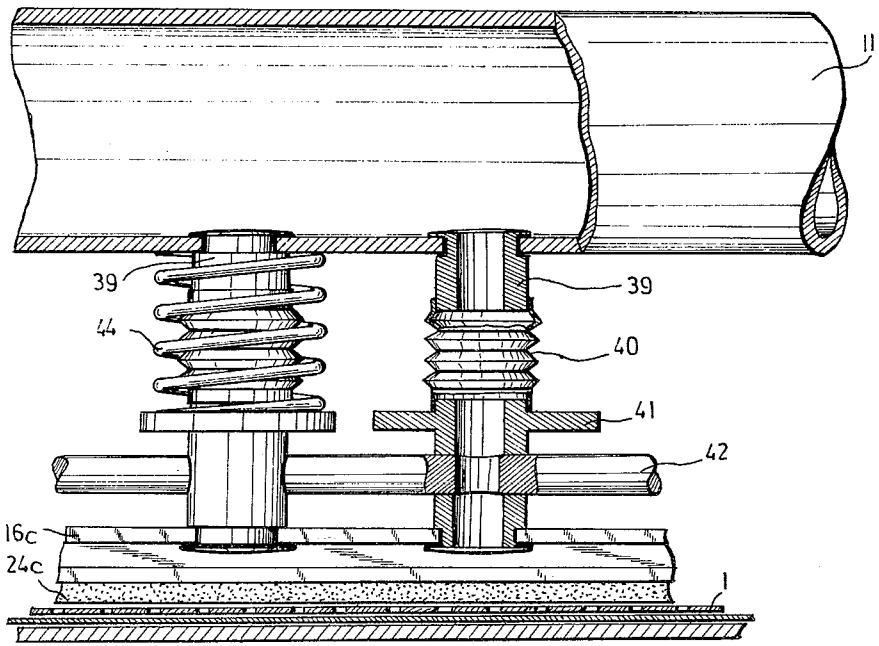

Another embodiment of my invention is shown in FIGS. 6 and 7 where a supply tube 11*c* is connected via elastically deformable coupling elements with a vertically movable distributing member 16*c* having a discharge slot 18*c*. The ink emerges from the tube 11*c* through nipples 39 and passes into elastic corrugated conduits 40 which consist, for instance, of rubber tubing. From these corrugated conduits the ink passes via nipples 41 into distributor 16*c* which are traversed by a common rotatable shutter rod 42 by which the ink flow to the outlet 18*c* can be interrupted. The nipples 41 are fastened in the member 16*c* by soldering. While in this case also I prefer to make the sum of the cross-sectional areas 43, i.e. the end faces of the nipples 41, larger than the outlet cross-section 26 of the slot 18*c*, the pressure acting on the movable member 16*c* can be intensified by coil springs 44 surrounding the conduits 40 whereby satisfactory contact with the screen 1 is assured at all times. Lugs 45 on tube 11*c* and links 46, which are articulated to these lugs 45 by pins 47 and with straps 50 on member 16*c* by pins 48, hold that member at all times in its proper position below tube 11*c*.

The mobility of the distributing member 16*c* in the vertical direction 20 with respect to the screen 1 is not impeded by this linkage. Supply tube 11*c* can readily experience flexural deformation without unduly stressing the movable member 16*c* or impairing its seal with respect to the screen 1. With this construction the sealing strip 24*c*, resting on the inside of screen 1, is slightly tiltable which may be advantageous in cases where a deformation of the screen surfaces 1 is to be expected on account of irregularities of the substrate, as with high-pile goods.

Figure 8:
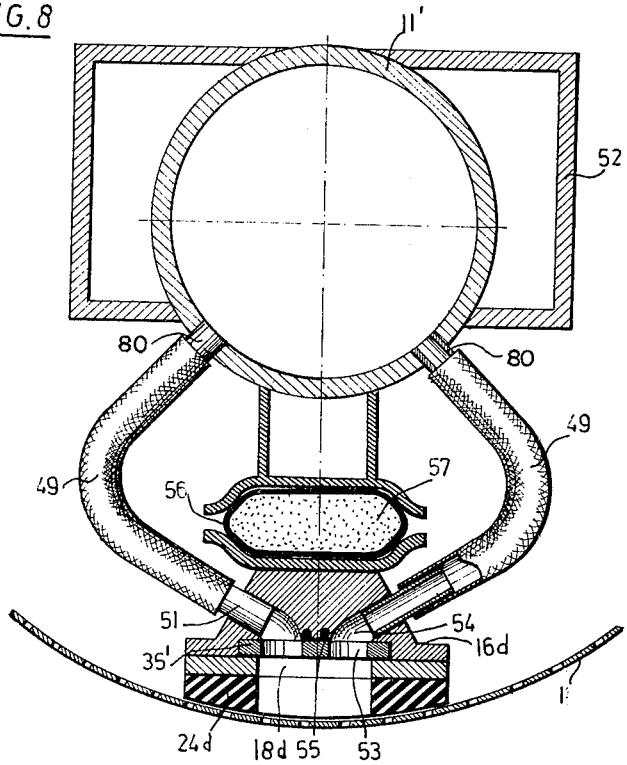
FIGS. 8 and 9 are cross-sectional views, taken in different planes, of a modified construction generally similar to that shown in FIGS. 6 and 7.
Figure 9:
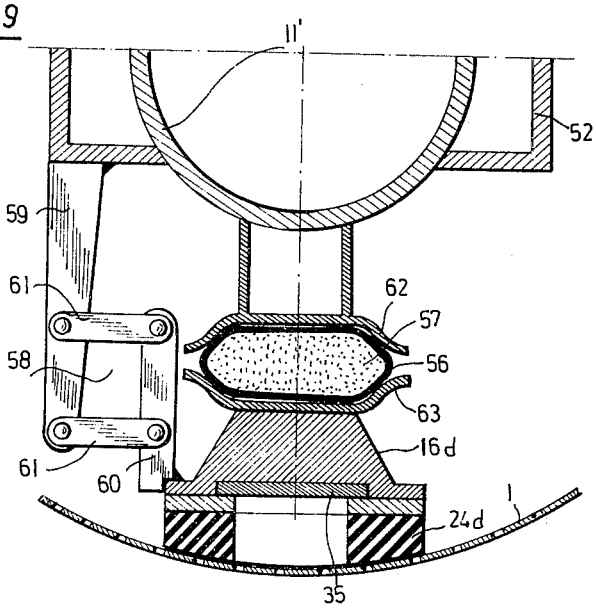

In FIGS. 8 and 9 I have shown a modification of the construction of FIGS. 6 and 7 without such tiltability. A supply tube 11′ is in this case connected to the movable distributing member 16*d* via flexible hoses 49 which are connected to the tube by soldered nipples 60 and to member 16*d* by soldered nipples 51 received in ports 54. The tube 11′ has laterally projecting reinforcements 52 of C-shaped profile which serve to stiffen it in horizontal direction against oscillations due to irregular flow. Member 16*d* is again provided with a shutter slide 35′ in the form of a flat iron strip having holes 53 through which the ink can enter into a distributing channel 18*d*, registering with an outlet slot in a sealing strip 24*d*, when the shutter is in its nonblocking position. A seal between the shutter 35′ and the ports 54 is effected by O-rings 55. In this embodiment the downward pressure on member 16*d* against the screen 1 is provided by an elastic hollow body or pad 56 which is filled with a fluid 57 under pressure and absorbs longitudinal deformations which unavoidably occur on the supply tube 11′ so that, again, the vertically movable member 16*d* itself does not experience any flexural stressing but is subjected merely, via the pad 56, to pure compressive forces.

Member 16*d* is coupled with one of the extensions 52 of tube 11′ by means of a parallelogrammatic linkage 58 designed to prevent any canting or tilting of member 16*d*, aside from a small play in the angular position of this member due to the unavoidable manufacturing tolerances which occur particularly at the points of articulation of the linkage 58. The parallelogram 58 consists of two vertical arms 59 and 60 and two horizontal links 61. The elastic pad 56, as can be noted from the drawing, is held between retaining plates 62 and 63 under a pressure as uniform as possible. As pressure fluid, both liquids and gases can be used. Gases have the particular advantage that the contact pressure of the member 16*d* can be varied by a simple change in the vertical position of the tube 11′, albeit with a relatively steep characteristic. If the pad 56 contains a liquid under pressure, a change in the contact pressure can be brought about with the aid of the preferably resilient holders 14 engaging the ends of the tube 11′.

The applicability of this invention is not limited to the field of printing but extends to any treatment of a web-shaped substrate to which liquid or pasty substances must be transmitted in selected areas so as to pass through it or at least penetrate it in part.

I claim:

1. In a device for treating selected portions of a substrate, in combination:

an apertured screen overlying a substrate to be treated along a contact area, said screen and said substrate being movable in a predetermined direction;

a horizontal supply tube with an axis in a plane perpendicular to said predetermined direction, said tube being connected to a source of treatment liquid and spacedly disposed above said contact area; and an applicator for said liquid including a guide structure secured to the underside of said tube and an elongate distributing member vertically movable within said guide structure in an axial plane of said tube, said distributing member forming an outlet for said liquid along a narrow zone of said contact area centered on said axial plane, said applicator forming a multiplicity of passages transverse to said axis connecting the interior of said tube with said outlet, said member resting on said screen in said contact area, said guide structure including conduit means communicating with said passages and with the interior of said tube.

2. The combination defined in claim 1 wherein said passages terminate within said member in a common distributing channel paralleling said outlet and communicating therewith.

3. The combination defined in claim 2, further comprising shutter means in said member between said passages and said channel for selectively blocking the flow of said liquid.

4. The combination defined in claim 3 wherein said shutter means comprises an elongate element common to all said passages extending parallel to the tube axis.

5. The combination defined in claim 1 wherein said guide structure comprises a block forming a chamber slidably receiving said member, said tube having apertures opening into said chamber.

6. The combination defined in claim 5 wherein said chamber is subdivided into a multiplicity of axially spaced cylinders aligned with said apertures, said member including a corresponding multiplicity of pistons respectively received in said cylinders and provided with bores forming part of said passages.

7. The combination defined in claim 6 wherein the combined cross-sectional area of said cylinders exceeds the effective area of said outlet.

8. The combination defined in claim 1 wherein said guide structure comprises a multiplicity of upper nipples extending downwardly from the underside of said tube, said member being provided with a like multiplicity of lower nipples respectively aligned with said upper nipples and movably connected therewith.

9. The combination defined in claim 8 wherein the connections between said upper and lower nipples comprise corrugated tubing.

10. The combination defined in claim 9, further comprising a stabilizing linkage independent of said tubing between said tube and said member.

11. The combination defined in claim 8, further comprising spring means inserted between said upper and lower nipples for exerting a downward pressure upon said member.

12. In a device for treating selected portions of a substrate, in combination:

an apertured screen overlying a substrate to be treated along a contact area, said screen and said substrate being movable in a predetermined direction;

a horizontal supply tube with an axis in a plane perpendicular to said predetermined direction, said tube being connected to a source of treatment liquid and spacedly disposed above said contact area;

an applicator for said liquid including a guide structure secured to the underside of said tube and an elongate distributing member vertically movable within said guide structure in an axial plane of said tube, said distributing member forming an outlet for said liquid along a narrow zone of said contact area centered on said axial plane, said applicator forming a multiplicity of passages transverse to said axis connecting the interior of said tube with said outlet and terminating within said member in a common distributing channel paralleling said outlet and communicating therewith, said member resting on said screen in said contact area; and an elongate shutter element common to all said passages extending parallel to said axis in said member between said passages and said channel for selectively blocking the flow of said liquid.

13. The combination defined in claim 12 wherein said screen is cylindrical, said applicator extending within the cylindrical screen parallel to the cylinder axis.

14. In a device for treating selected portions of a substrate, in combination:

an apertured screen overlying a substrate to be treated along a contact area, said screen and said substrate being movable in a predetermined direction;

a horizontal supply tube with an axis in a plane perpendicular to said predetermined direction, said tube being connected to a source of treatment liquid and spacedly disposed above said contact area, said tube being provided with lateral reinforcements;

an applicator for said liquid including a guide structure secured to the underside of said tube and an elongate distributing member vertically movable within said guide structure in an axial plane of said tube, said distributing member forming an outlet for said liquid along a narrow zone of said contact area centered on said axial plane, said applicator forming a multiplicity of passages connecting the interior of said tube with said outlet, said member resting on said screen in said contact area;

a fluid cushion inserted between said tube and said member for exerting a downward pressure upon the latter; and an articulated linkage interconnecting said tube and said member, said linkage being anchored to one of said reinforcements.

15. The combination defined in claim 14 wherein said linkage is a parallelogram.

16. In a device for treating selected portions of a substrate, in combination:

an apertured screen overlying a substrate to be treated along a contact area, said screen and said substrate being movable in a predetermined direction;

a horizontal supply tube with an axis in a plane perpendicular to said predetermined direction, said tube being connected to a source of treatment liquid and spacedly disposed above said contact area;

an applicator for said liquid including a guide structure secured to the underside of said tube and an elongate distributing member vertically movable within said guide structure in an axial plane of said tube, said distributing member forming an outlet for said liquid along a narrow zone of said contact area centered on said axial plane, said applicator forming a multiplicity of passages connecting the interior of said tube with said outlet, said member resting on said screen in said contact area;

a fluid cushion inserted between said tube and said member for exerting a downward pressure upon the latter; and an articulated parallelogrammatic linkage interconnecting said tube and said member.

* * * * *